US006853824B2

(12) United States Patent
Kashiwabara et al.

(10) Patent No.: US 6,853,824 B2
(45) Date of Patent: Feb. 8, 2005

(54) ELECTROPHOTOGRAPHIC ENDLESS BELT COMPRISING MEANDERING-PREVENTIVE MEMBER, AND PROCESS CARTRIDGE AND ELECTROPHOTOGRAPHIC APPARATUS HAVING SUCH AN ENDLESS BELT

(75) Inventors: Ryota Kashiwabara, Shizuoka (JP); Hiroyuki Kobayashi, Shizuoka (JP); Akihiko Nakazawa, Shizuoka (JP); Atsushi Tanaka, Shizuoka (JP); Tsunenori Ashibe, Kanagawa (JP); Takashi Kusaba, Shizuoka (JP); Hidekazu Matsuda, Shizuoka (JP); Yuji Sakurai, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 40 days.

(21) Appl. No.: 10/372,097

(22) Filed: Feb. 25, 2003

(65) Prior Publication Data

US 2003/0206749 A1 Nov. 6, 2003

(30) Foreign Application Priority Data

Apr. 26, 2002 (JP) ..... 2002-125995
Jul. 9, 2002 (JP) ..... 2002-200081
Sep. 30, 2002 (JP) ..... 2002-286047

(51) Int. Cl.[7] ..... G03G 15/00; G03G 15/08; G03G 15/01

(52) U.S. Cl. ..... 399/165; 399/121; 399/302

(58) Field of Search ..... 399/110, 111, 399/121, 162, 165, 301, 302, 308; 347/116; 250/306

(56) References Cited

U.S. PATENT DOCUMENTS 4,873,548 A 10/1989 Kobayashi et al.
5,103,095 A * 4/1992 Elings et al. ..... 250/306
5,331,373 A 7/1994 Nomura et al.
5,446,525 A 8/1995 Kobayashi
5,452,056 A 9/1995 Nomura et al.
5,585,889 A 12/1996 Shishido et al.
5,585,902 A 12/1996 Nishiuwatoko et al.
5,713,067 A 1/1998 Mizoe et al. ..... 399/176
5,752,131 A 5/1998 Fujiwara et al. ..... 399/106
5,870,654 A 2/1999 Sato et al. ..... 399/109
5,903,805 A * 5/1999 Ueda et al. ..... 399/165
5,966,566 A 10/1999 Odagawa et al. ..... 399/109
6,321,052 B1 * 11/2001 Yamashina et al. ..... 399/165
6,496,672 B2 * 12/2002 Asuwa et al. ..... 399/165
2001/0031153 A1 * 10/2001 Sameshima et al. ..... 399/165
2002/0159789 A1 10/2002 Kusaba et al. ..... 399/111

FOREIGN PATENT DOCUMENTS

JP 9-96943 4/1997

* cited by examiner

*Primary Examiner*—Sandra Brase
(74) *Attorney, Agent, or Firm*—Fitzpatrick, Cella, Harper & Scinto

(57) ABSTRACT

In an electrophotographic endless belt having a beltlike substrate, a meandering-preventive member and a position detection member, the meandering-preventive member is disposed on the inner-periphery side of one end portion of the beltlike substrate, the position detection member is disposed on the outer-periphery side of the other end portion of the beltlike substrate, and the meandering-preventive member and the position detection member are 200 mm to 250 mm away from each other in the width direction of the electrophotographic endless belt. The beltlike substrate contains a thermoplastic resin as a binder resin, and the beltlike substrate has a 25 $\mu$m×25 $\mu$m surface total current value of from 300 nA to 2,000 nA at the time of application of 100 V as measured by SPM.

17 Claims, 6 Drawing Sheets

ELECTROPHOTOGRAPHIC ENDLESS BELT COMPRISING MEANDERING-PREVENTIVE MEMBER, AND PROCESS CARTRIDGE AND ELECTROPHOTOGRAPHIC APPARATUS HAVING SUCH AN ENDLESS BELT

BACKGROUND OF THE INVENTION

1. Field of the Invention

This invention relates to an electrophotographic endless belt, in particular, an intermediate transfer belt, and also relates to a process cartridge and an electrophotographic apparatus which have the intermediate transfer belt and an electrophotographic photosensitive member.

2. Related Background Art

Besides rigid-body, drum-shaped members, flexible endless-belt-shaped members (electrophotographic endless belts) are conventionally used in intermediate transfer belts, electrophotographic photosensitive members, transfer-transport members, fixing members, and so forth used in electrophotographic apparatus, such as copying machines and laser beam printers.

Usually, in an electrophotographic apparatus, an electrophotographic endless belt is put over, and supported on, at least two rollers disposed on its inner-periphery side and is rotatably driven under application of any desired tension when used.

However, because of slight errors or scattering in the diameter, deflection, rotating-shaft straightness and roller-to-roller parallelism of the rollers supporting the electrophotographic endless belt, it is inevitable that the electrophotographic endless belt meander from side to side during its rotating drive.

Such meandering of the electrophotographic endless belt from side to side makes the exposure position and the transfer position deviate to cause image misregistration. Also, in the case of a full-color electrophotographic apparatus, it makes the position of image formation deviate for each color to cause color misregistration (or color shift) when color toner images are superimposed on the electrophotographic endless belt or on a transfer material transported on the electrophotographic endless belt.

Accordingly, in order to prevent the electrophotographic endless belt from meandering, various methods have ever been proposed. In recent years, methods in which a meandering-preventive member is provided on the inner periphery of a beltlike substrate of the electrophotographic endless belt to prevent the electrophotographic endless belt from meandering are proposed in a large number.

For example, a method is available in which a roller provided over the whole outer periphery thereof with a groove that may fit in the cross-sectional shape of such a meandering-preventive member is used and an electrophotographic endless belt provided with the meandering-preventive member over the whole inner periphery is rotated, making the meandering-preventive member fit in this groove of the roller to prevent the belt from meandering.

As another example, a method is available in which a roller having substantially the same length as the distance between the inner sides of meandering-preventive members provided on both ends of a beltlike substrate of an electrophotographic endless belt is used and the belt is put over this roller and is rotated making its both-end meandering-preventive members and the roller fit in each other to prevent the belt from meandering.

As still another example, a method is available in which a roller, provided on one end in the axial direction thereof with a terraced portion in which a meandering-preventive member of an electrophotographic endless belt fits, is used to prevent the electrophotographic endless belt from meandering.

The above methods can make the electrophotographic endless belt travel smoothly without meandering. This enables good images free of any image misregistration or color misregistration to be formed.

Meanwhile, usually, where the electrophotographic endless belt is used in an electrophotographic apparatus, it has some means for controlling the position at which a toner image begins to be written.

For example, Japanese Patent Application Laid open No. 9-96943, and so forth, discloses a method in which a mark (a position detection member) is provided on a beltlike substrate of an electrophotographic endless belt and the writing of an image is started upon detection of this mark. This method is preferable because the detection can very inexpensively be made and also the apparatus can be made compact.

Now, usually, electrophotographic endless belts mostly have a small layer thickness from the viewpoint of making electrophotographic apparatus compact and light-weight, and are also required to have a certain amount of flexibility because they are used in the state in which the belt is put over rollers having a small diameter.

On the other hand, the meandering-preventive member fitted to a beltlike substrate of the electrophotographic endless belt is required to have a rigidity high enough to be durable with respect to the draw force of the electrophotographic endless belt.

Where the beltlike substrate of such a thin-film and flexible electrophotographic endless belt is provided with a rigid meandering-preventive member, a slight difference is produced in the flexing degree of the electrophotographic endless belt when the electrophotographic endless belt is put over the rollers, because there is a difference in stiffness (nerve or rigidity) between the part provided with the meandering-preventive member and the part not provided with it.

In the case when the meandering-preventive member is provided on the inner periphery of the beltlike substrate of the electrophotographic endless belt and the position detection member is provided on the outer periphery of that part, it has occurred in conventional cases that, as shown in FIG. 7, a meandering-preventive member 82 fitted in a groove 86 of a roller 87 rises because of this slight difference in flexing properties and consequently a beltlike substrate 81 of an electrophotographic endless belt and a position detection member 83 also rise to make any accurate detection impossible to cause image misregistration (reference numeral 84 denotes a light-projecting part of a position detection sensor, and reference numeral 85 denotes a light-receiving part of the position detection sensor).

It is also the case for the meandering-preventive member that, usually, a member cut beforehand to a length adjusted to the inner-peripheral length of the beltlike substrate is attached to the inner periphery of the beltlike substrate. In such a case, it is unavoidable for the meandering-preventive member to have a joint. In particular, where the position detection member is present on the joint, it is impossible to make any accurate position detection because of an extreme difference in flexing properties. In order to avoid this, the joint of the meandering-preventive member may be avoided when the position detection member is fitted, or the position of the position detection member may be avoided when the meandering-preventive member is fitted. However, taking account of a mass production process, the addition of a step of determining and avoiding the joint of the meandering-preventive member or the position of the position detection member causes a lowering of productivity or an increase in management, resulting in an increase in cost.

Accordingly, as a means for preventing the meandering-preventive member from rising, a method is available in which the tension (belt tension) applied when the electrophotographic endless belt is put over is made higher. There, however, is a possibility that making the tension higher causes a creep of the electrophotographic endless belt to shorten its lifetime. Also, too a high belt tension may further promote the meandering of the electrophotographic endless belt.

Conventionally, in order to solve such problems, it has been necessary to use a meandering-preventive member having a relatively low rigidity. However, the use of such a meandering-preventive member having a low rigidity may weaken the effect of preventing the belt from meandering in the width direction. In a bad case, it has even occurred that the meandering-preventive member runs on the roller.

In particular, where a process cartridge, in which an electrophotographic photosensitive member and an intermediate transfer belt are integrally supported, is used, differently from a case in which it is actually installed and used in the main body of an electrophotographic apparatus, it may often undergo many vibrations or be placed in a high-temperature and high-humidity environment for a long time during distribution in the market. When it is placed in such a severe environment for a long time, the progress of the creep of the belt is accelerated, and moreover the belt may come to have the habit of bending (or permanent bending) as a result of compression set. When the position detection member is present here, a problem may arise such that any accurate position detection can not be made. For such reasons, the above problems may more remarkably arise when the process cartridge in which an electrophotographic photosensitive member and an intermediate transfer belt are integrally supported is used.

SUMMARY OF THE INVENTION

An object of the present invention is to provide an electrophotographic endless belt which enables good images free of image misregistration or color misregistration to be formed, without causing the problems arising from the method of making the belt tension higher and the method making use of a low-rigidity meandering-preventive member.

Another object of the present invention is to provide a process cartridge and an electrophotographic apparatus which have employed the above electrophotographic endless belt as an intermediate transfer belt.

As a result of extensive studies, the present inventors have first discovered that the above objects can be achieved by an electrophotographic endless belt having a beltlike substrate, a meandering-preventive member and a position detection member, wherein the meandering-preventive member is disposed on the inner-periphery side of one end portion of the beltlike substrate, the position detection member is disposed on the outer-periphery side of the other end portion of the beltlike substrate, and the meandering-preventive member and the position detection member are 200 mm to 250 mm away from each other in the width direction of the electrophotographic endless belt.

It, however, has been found that, when the electrophotographic endless belt, in which the meandering-preventive member and the position detection member are disposed as described above, is used (especially when used as an intermediate transfer belt), stripelike defects appear in images reproduced in a severe environment of high-temperature and high-humidity. This problem has not so often occurred when images are reproduced in the environment other than the high-temperature and high-humidity environment (such as a normal-temperature and a normal-humidity environment).

In the high-temperature and high-humidity environment, a primary transfer roller and the intermediate transfer belt tend to have unstable resistance and may temporarily have a high resistance, so that an electric discharge phenomenon occurs when the primary transfer roller and the intermediate transfer belt are separated from each other during driving. In addition, when providing the meandering-preventive member in such a manner as described above, the electrophotographic endless belt (the intermediate transfer belt) is more strongly rubbed with the electrophotographic photosensitive member. Thus, it is considered that the above problems more often occur.

Accordingly, the present inventors have further pushed their studies forward. As a result, they have discovered that, in addition to the meandering-preventive member and the position detection member which are disposed as described above, a thermoplastic resin is further employed as a binder resin of the beltlike substrate and also the beltlike substrate is made to have a 25 $\mu$m×25 $\mu$m surface total current value of from 300 nA to 2,000 nA at the time of application of 100 V as measured by SPM (scanning-probe microscopy), whereby no stripelike defects appear even when the electrophotographic endless belt is used in which the meandering-preventive member and the position detection member are disposed as described above.

More specifically, the present invention provides an electrophotographic endless belt having a beltlike substrate, a meandering-preventive member and a position detection member, wherein the meandering-preventive member is disposed on the inner-periphery side of one end portion of the beltlike substrate;

the position detection member is disposed on the outer-periphery side of the other end portion of the beltlike substrate;

the meandering-preventive member and the position detection member are 200 mm to 250 mm away from each other in the width direction of the electrophotographic endless belt;

the beltlike substrate contains a thermoplastic resin as a binder resin; and the beltlike substrate has a 25 $\mu$m×25 $\mu$m surface total current value of from 300 nA to 2,000 nA at the time of application of 100 V as measured by SPM.

The present invention also provides a process cartridge and an electrophotographic apparatus which have employed the above electrophotographic endless belt as an intermediate transfer belt.

BRIEF DESCRIPTION OF THE INVENTION

Figure 5:
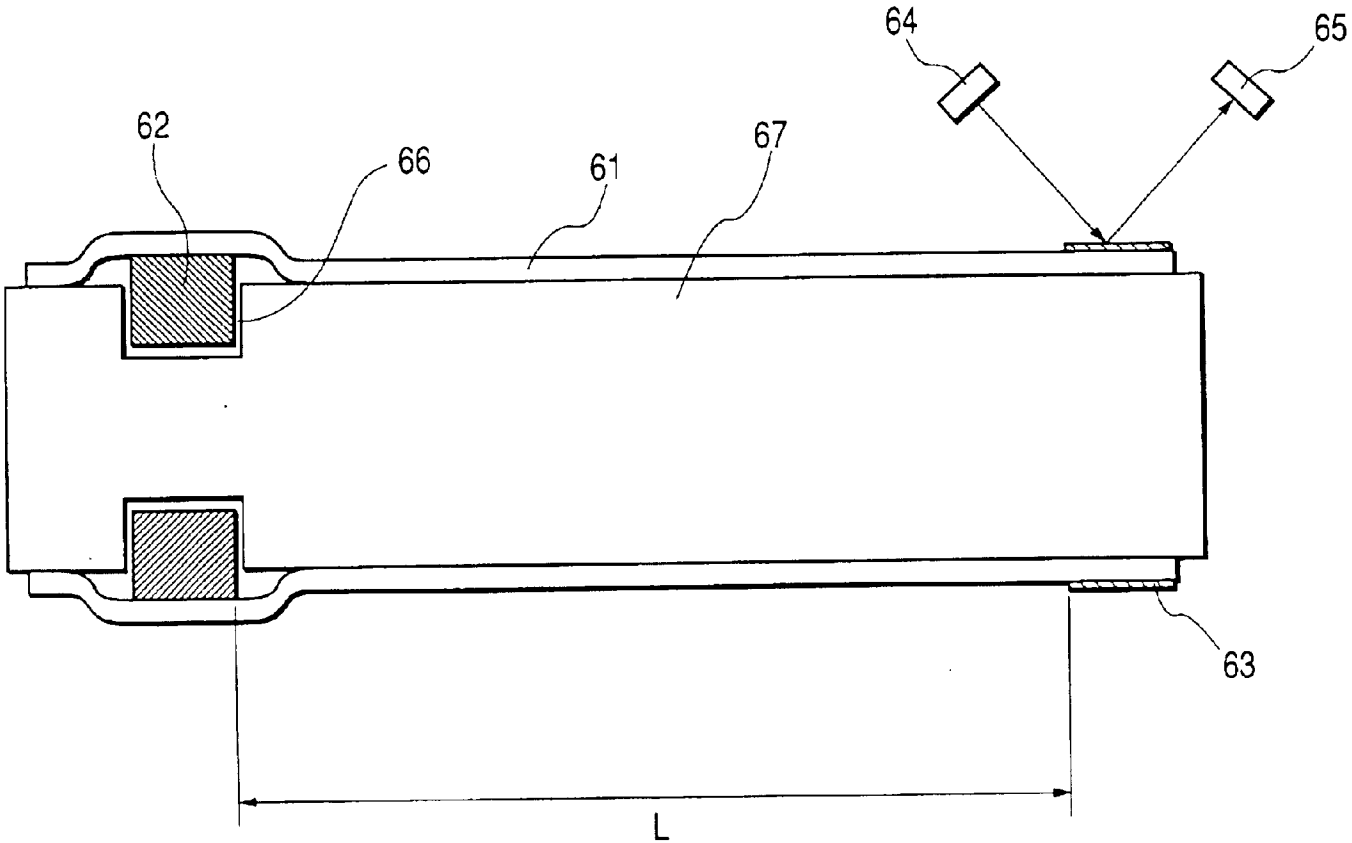

FIG. 5 is a view showing the relationship between the electrophotographic endless belt and the position detection sensor in the present invention and a case in which a roller provided over the whole outer periphery thereof with a groove that may fit in the cross-sectional shape of the meandering-preventive member is used and an electrophotographic endless belt provided with the meandering-preventive member over the whole inner periphery is rotated while making the meandering-preventive member fit in this groove of the roller to prevent the belt from meandering.

Figure 6:
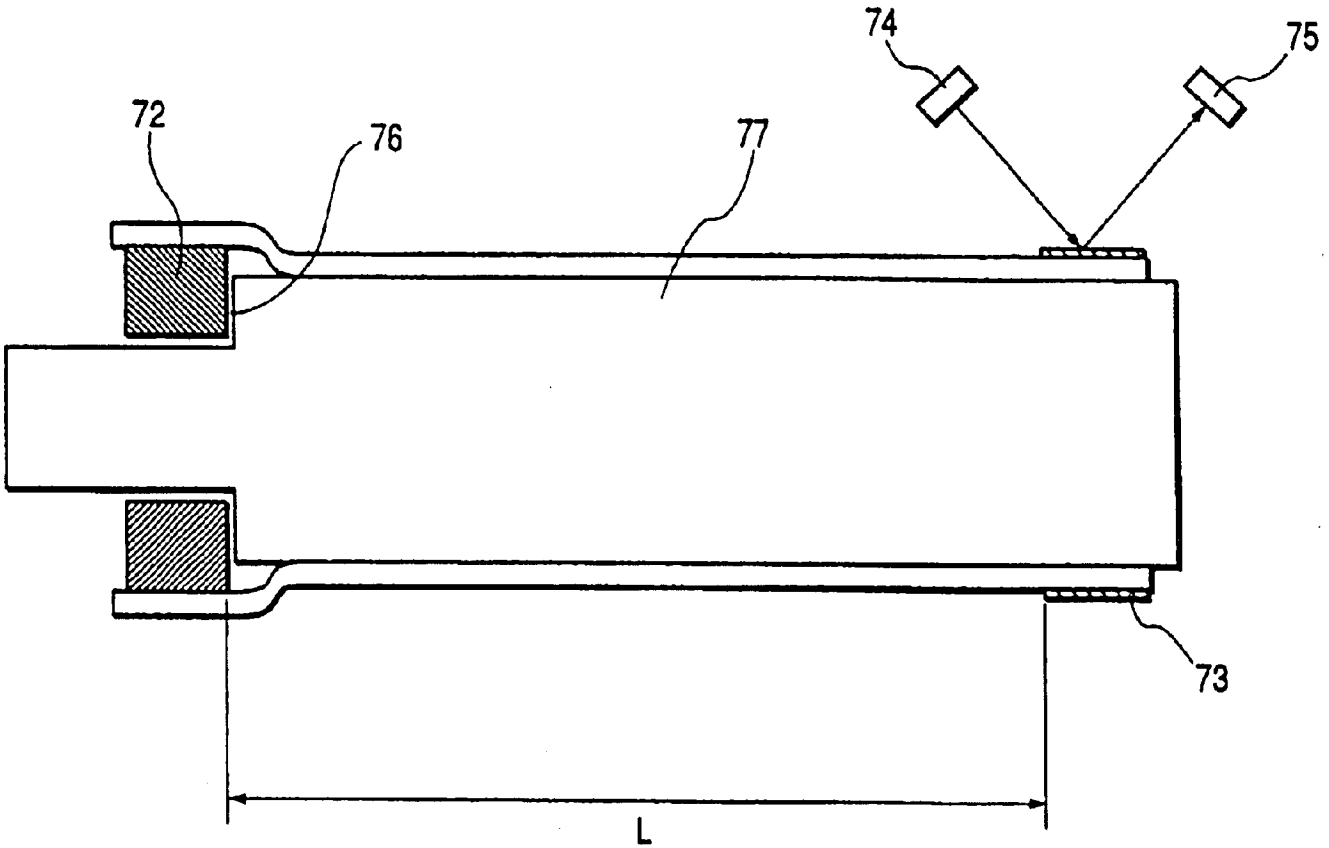

FIG. 6 is a view showing the relationship between the electrophotographic endless belt and the position detection sensor in the present invention and a case in which a roller provided on one end in the axial direction thereof with a terraced portion in which the meandering-preventive member fits is used to prevent the electrophotographic endless belt from meandering.

Figure 7:
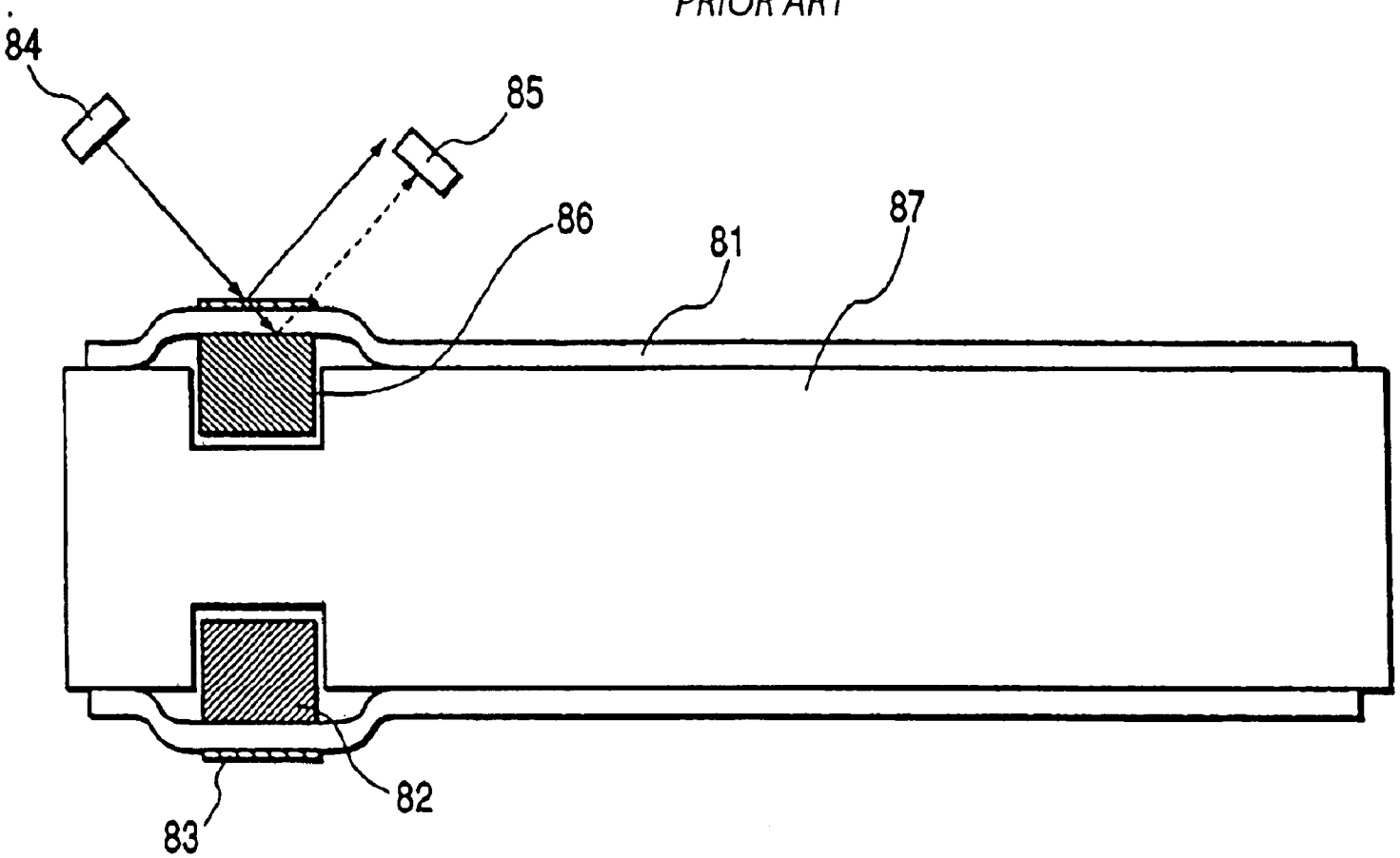
FIG. 7 PRIOR ART

FIG. 7 is a view showing an electrophotographic endless belt and a position detection sensor in a conventional case.

DESCRIPTION OF THE PREFERRED EMBODIMENTS

The present invention is described below in detail.

First, the electrophotographic endless belt of the present invention has a beltlike substrate, a meandering-preventive member and a position detection member. Then, in order to prevent any position detection difference due to a rise at the beltlike substrate surface of the meandering-preventive member, caused by differences in the thickness, physical properties and flexing properties between the beltlike substrate and the meandering-preventive member, as shown in FIG. 5, a meandering-preventive member 62 for preventing the electrophotographic endless belt from meandering is disposed on the inner-periphery side of one end portion of a beltlike substrate 61, and a position detection member 63 for detecting a preset position of the electrophotographic endless belt is disposed on the outer-periphery side of the other end portion of the beltlike substrate 61. Then, the meandering-preventive member 62 and the position detection member 63 are set apart by a distance of from 200 mm to 250 mm. Reference numeral 64 denotes a light-projecting part of a position detection sensor, and reference numeral 65 denotes a light-receiving part of the position detection sensor. Also, reference numeral 66 denotes a groove in which the meandering-preventive member 62 is fitted.

Shown in FIG. 5 is an embodiment in which a roller 67, provided over the whole outer periphery thereof with the groove 66 that may fit in the cross-sectional shape of the meandering-preventive member 62, is used and in which the electrophotographic endless belt provided with the meandering-preventive member 62 over the whole inner periphery is rotated making the meandering-preventive member 62 fit in this groove 66 of the roller 67 to prevent the belt from meandering. Instead, as shown in FIG. 6, an embodiment may be employed in which a roller 77, provided on one end in the axial direction thereof with a terraced portion 76 in which the meandering-preventive member fits, is used to prevent the electrophotographic endless belt from meandering. In FIG. 6, reference numeral 72 denotes a meandering-preventive member, reference numeral 73 denotes a position detection member, reference numeral 74 denotes a light-projecting part of a position detection sensor; reference numeral 75 denotes a light-receiving part of the position detection sensor, reference numeral 76 denotes the terraced portion; and reference numeral 77 denotes the roller over which the electrophotographic endless belt is put.

In FIGS. 5 and 6, letter l L denotes the distance between the meandering-preventive member and the position detection member.

If as shown in FIG. 7 the position detection member is fitted to an end of the roller on the same side as the end where the meandering-preventive member has been disposed, the position detection member is affected by a rise of the meandering-preventive member to make any accurate detection impossible, resulting in a lowering of the precision of position detection made by the position detection sensor and the position detection member.

The electrophotographic endless belt (beltlike substrate) may also usually have a width ranging from 200 mm to 400 mm. If it has a width of less than 200 mm, the adaptable paper size becomes too limited (to be adaptable to, e.g., A4 size). If it has a width of more than 400 nm, it makes the electrophotographic apparatus large-size. Further taking account of the goals to provide both a compact electrophotographic apparatus and an electrophotographic apparatus adaptable to different paper sizes, the electrophotographic endless belt (beltlike substrate) may preferably have a width ranging from 220 mm to 350 mm.

Accordingly, it is preferable for the meandering-preventive member and the position detection member to be set apart by a distance of from 200 mm to 250 mm in the width direction of the electrophotographic endless belt. If the set-apart distance is less than 200 mm, not only may the position detection precision be lower, but also there is a possibility that they come to the image formation region. If, on the other hand, it is more than 250 mm, the electrophotographic endless belt becomes large in size, consequently making the electrophotographic apparatus large-size.

It is more preferable for the meandering-preventive member and the position detection member to be set apart by a distance of from 220 mm to 250 mm.

Setting apart the meandering-preventive member and the position detection member makes it unnecessary to detect the joint of the meandering-preventive member so as to avoid it, and may cause neither a lowering of productivity, nor a rise in costs.

Setting apart the meandering-preventive member and the position detection member can also prevent making the belt tension higher than is necessary, and makes it possible for the electrophotographic endless belt to be put over the roller at an appropriate tension. Hence, its creep can be kept from occurring, consequently leading to increasing of the lifetime of the belt. In the present invention, the belt tension may preferably range from 5 N to 70 N.

Setting apart the meandering-preventive member and the position detection member still also makes it possible to use a meandering-preventive member with a high modulus of elasticity, having a higher meandering-preventive effect, which has not been used because of its high rigidity, so that the color misregistration or the like can vastly be prevented from occurring. In the present invention, the meandering-preventive member may preferably have a modulus of elasticity ranging from 0.01 Pa to 100 MPa, and more preferably from 0.1 Pa to 50 MPa The meandering-preventive member and the position detection member may also preferably be disposed at a place outside the range in which the toner for forming a desired image is to be laid (image formation region) (i.e., disposed at a non-image formation region), and within the range that they do not make the electrophotographic apparatus large-size. If the meandering-preventive member and the position detection member are disposed in the image formation region, images may adversely be affected by a rise of the meandering-preventive member or a bump of the electrophotographic endless belt, which is ascribable to the thickness of the position detection member.

A plurality of position detection members may also preferably be provided on the beltlike substrate of the electrophotographic endless belt. If the position detection member is present only at one spot in the peripheral direction of the electrophotographic endless belt, it inevitably takes a long time for the belt to rotate until the position detection member is detected after the switch has been turned on, and there is a possibility of causing a lowering of throughput.

The beltlike substrate of the electrophotographic endless belt of the present invention is composed chiefly of a thermoplastic resin, i.e., which contains a thermoplastic resin as a binder resin and in which a 25 $\mu$m×25 $\mu$m surface total current value is 300 nA to 2,000 nA as measured by SPM under the application of 100 V.

If the surface total current value is less than 300 nA, appropriate electric-charge leak sites may become short on the electrophotographic endless belt (beltlike substrate) and the toner is charged non-uniformly due to electric discharge in a high-temperature and high-humidity environment, causing stripelike image defects. This may further worsen any faulty images when any color misregistration of a plurality of colors has occurred. If, on the other hand, the surface total current value is more than 2,000 nA, the belt may cause, in the high-temperature and high-humidity environment, not only stripelike image defects, but also an extreme lowering of breakdown strength of the electrophotographic endless belt (beltlike substrate).

The electrophotographic endless belt (beltlike substrate) may more preferably have a 25 $\mu$m×25 $\mu$m surface total current value of from 600 nA to 1,000 nA.

As the thermoplastic resin, it may include, e.g., olefin resins such as polyethylene and polypropylene, polystyrene resins, acrylic resins, ABS resins, polyester resins (such as PET, PBT, PEN and PAR), polycarbonate resins, sulfur-containing resins such as polysulfone, polyether sulfone and polyphenylene sulfide, fluorine-containing resins such as polyvinylidene fluoride and a polyethylene-tetrafluoroethylene copolymer, polyurethane resins, silicone resins, ketone resins, polyvinylidene chloride, thermoplastic polyimide resins, polyamide resins, modified polyphenylene oxide resins, and various modified resins or copolymers of these, any one or more kinds of which may be used.

When the electrophotographic endless belt is used in the electrophotographic apparatus, it is also necessary to regulate its electrical resistance value to be adapted to a specific electrophotographic process.

There are no particular limitations on the additives mixed in order to regulate the electrical resistance value of the intermediate transfer belt (beltlike substrate) of the present invention. As a conductive filler for regulating the resistance, it may include carbon black and various conductive metal oxides. As a non-filler type resistance regulator, it may include low-molecular weight ion conducting materials, such as various metal salts and glycols, antistatic resins containing an ether linkage or a hydroxyl group in the molecule, and organic high polymers showing electroconductivity.

There are also no particular limitations on processes for obtaining the beltlike substrate of the electrophotographic endless belt of the present invention. As its forming process, a process for producing a seamless belt may be employed, and a production process having so high a production efficiency as to enable cost saving is preferred. As a method therefor, a method is available in which an extrusion material is continuously melt-extruded from a circular die and thereafter the product thus extruded is cut in any necessary length to produce a belt. For example, blown-film extrusion (inflation) is preferable.

An example of a method of producing the beltlike substrate of the electrophotographic endless belt used in the present invention is described below.

Figure 3:
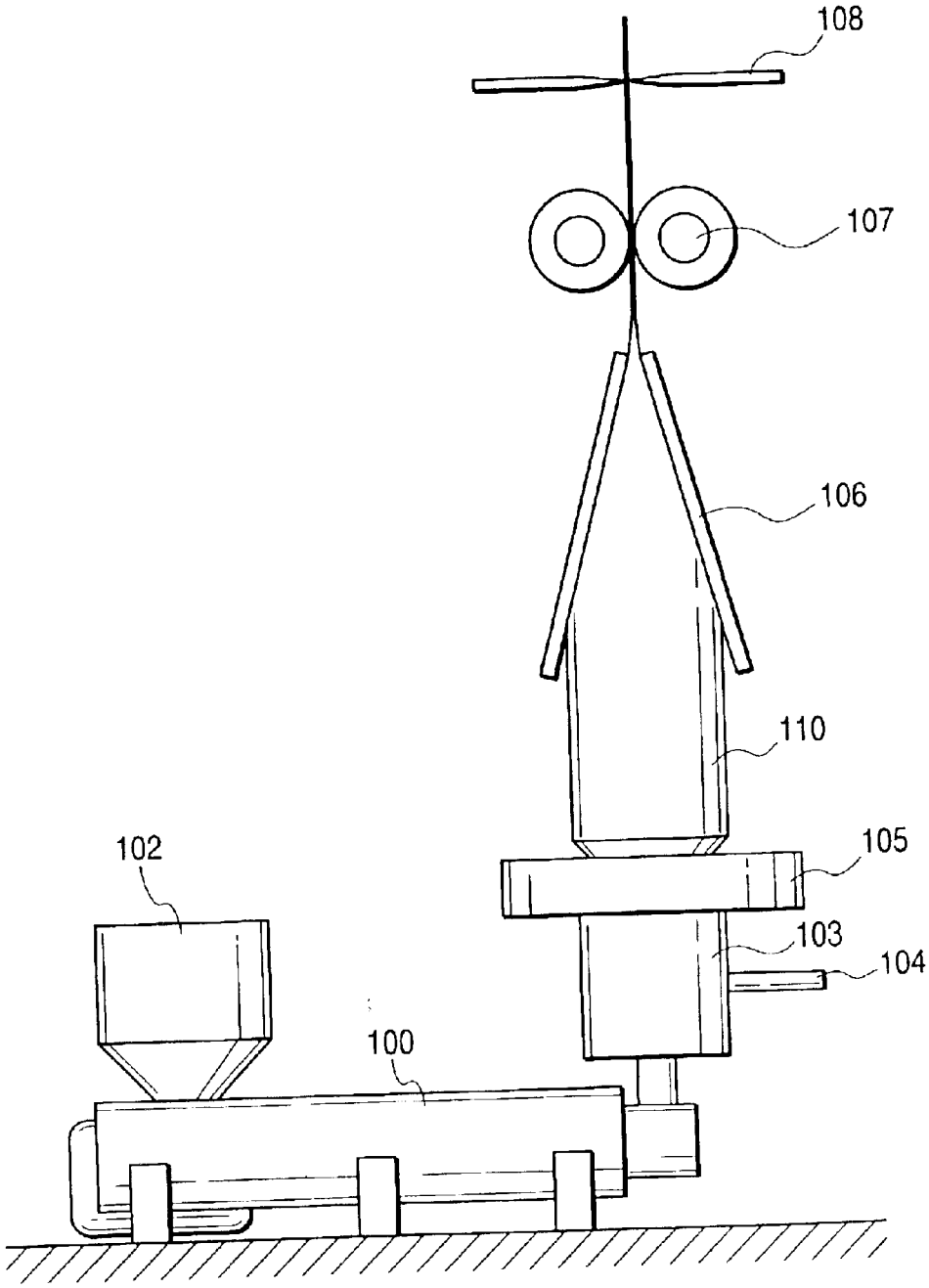
FIG. 3 is a schematic view showing an example of the construction of an extrusion apparatus for forming an intermediate transfer belt (single layer) of the present invention.

FIG. 3 schematically shows an example of the construction of an extrusion apparatus (blown-film extrusion apparatus) for forming the beltlike substrate of the electrophotographic endless belt of the present invention. This apparatus consists chiefly of an extruder, an extruder die and a gas blowing unit.

First, materials such as an extrusion resin (which may also be a rubber), a conducting agent and additives are premixed under the desired formulation and thereafter kneaded and dispersed to prepare an extrusion material, which is then put into a hopper 102 installed in an extruder 100.

The extruder 100 has a preset temperature and extruder screw construction which have been so selected that the extrusion material may have a melt viscosity necessary for enabling extrusion into a belt in the post step and also the materials can be dispersed uniformly with respect to one another.

The extrusion material is melt-kneaded in the extruder 100 into a melt, which then enters a circular die 103. The circular die 103 is provided with a gas inlet passage 104.

Through the gas inlet passage 104, gas (air) is blown into the center of the circular die 103, whereupon the melt having passed through the circular die 103 inflates while scaling up in the diametrical direction to come into a tubular film 110.

The gas to be blown here may be air, and besides may be selected from nitrogen, carbon dioxide and argon.

The extruded product having thus inflated (tubular film) is drawn upward while being cooled by an outside-cooling ring 105. Usually, in such a blown-film extrusion apparatus, a method is employed in which the tubular film 110 is pressed forcibly from the right and the left by means of stabilizing plates 106 to fold it into a sheet, and then drawn off at a constant speed while being so sandwiched with pinch rollers 107 that the air in the interior does not escape. Then, the tubular film thus drawn off is cut with a cutter 108 to obtain a tubular film with the desired size.

Next, this tubular film is worked using a form (for shaping) in order to regulate its surface smoothness and size and to remove any folds made in the film at the time of draw-off.

Stated specifically, a method is usable which makes use of a pair of cylindrical forms made of materials having different coefficients of thermal expansion and having different diameters. A small-diameter cylindrical form (inner form) has a coefficient of thermal expansion made larger than the coefficient of thermal expansion of a large-diameter cylindrical form (outer form). The tubular film obtained by extrusion is placed over this inner form. Thereafter, the inner form with the film is inserted into the outer form so that the tubular film is held between the inner form and the outer form. A gap between the inner form and the outer form may be determined by calculation on the bases of heating temperature, the difference in the coefficient of thermal expansion between the inner form and the outer form, and the pressure required.

A form in which the inner form, the tubular film and the outer form have been set in that order from the inside is heated to the vicinity of the softening point temperature of the resin used. As a result of the heating, the inner form, having a larger coefficient of thermal expansion, expands more than the inner diameter of the outer form and hence a uniform pressure is applied to the whole tubular film. Here, the surface of the tubular resin film having reached the vicinity of its softening point is pressed against the inner surface of the outer form having been worked smoothly, so that the smoothness of the surface of the tubular film is improved. Thereafter, these are cooled and the tubular film is removed from the forms, thus attaining smooth surface characteristics.

It is more preferable to use the above method as a method of obtaining (the beltlike substrate of) an electrophotographic endless belt having a small right-and-left difference in inner-peripheral length in order to prevent the belt from meandering.

Figure 4:
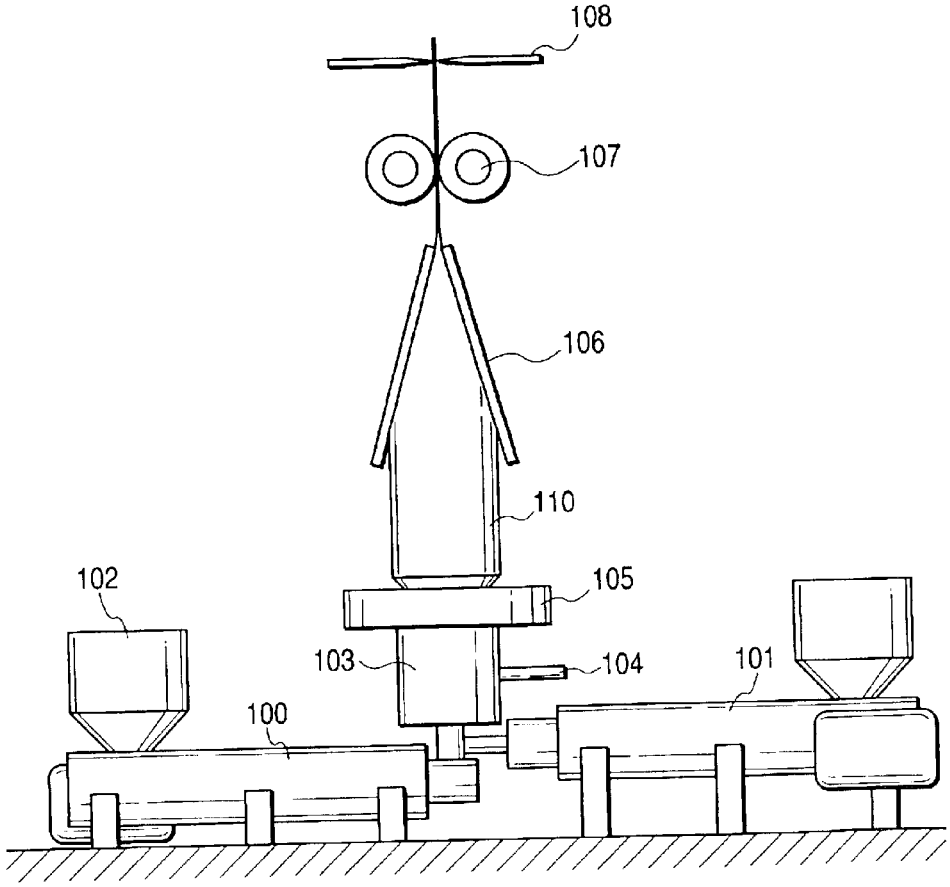
FIG. 4 is a schematic view showing an example of the construction of an extrusion apparatus for forming an intermediate transfer belt (double layer) of the present invention.

The foregoing description relates to a single-layer belt. In the case of the endless belt of double-layer construction, an extruder 101 is additionally provided as shown in FIG. 4. Simultaneously with the kneaded melt held in the extruder 100, a kneaded melt in the extruder 101 is sent to a double-layer circular die 103, and the two layers are inflated simultaneously, thus obtaining a double-layer belt.

In the case of triple- or more layer construction, the extruder may of course be provided in the number corresponding to the number of layers. Thus, the present invention makes it possible to extrude not only electrophotographic endless belts (beltlike substrates) of a single-layer construction, but also those of a multi-layer construction in good dimensional precision through one step and also in a short time. The fact that the extrusion can be made in a short time means that mass production and low-cost production can be made.

With regard to the thickness ratio of the extruded tubular film to the width of a gap (die slit) of the circular die, the ratio of the former to the latter may preferably be not more than ⅓, and particularly preferably not more than ⅕.

With regard to the ratio of the outer diameter of the tubular film to the outer diameter of the gap (die slit) of the circular die, it may preferably be in the range of from 50% to 400%.

These values represent the state of stretch of the material. If the thickness ratio is more than ⅓, the film may insufficiently stretch to tend to cause problems such as low strength, uneven resistance and uneven thickness. As for the ratio of the outer diameter of the tubular film to the outer diameter of the gap (die slit) of the circular die, if it is more than 400% or less than 50%, the film stretches in excess, resulting in a low extrusion stability or making it difficult to ensure the thickness necessary for the present invention.

In order to regulate the 25 $\mu$m×25 $\mu$m surface total current value of the beltlike substrate within the range of from 300 nA to 2,000 nA at the time of application of 100 V as measured by SPM, materials to be used (thermoplastic resins and various additives) and the state of dispersion of the materials must be controlled.

First, with regard to the materials to be used, the various materials as described previously may be used for the binder resin thermoplastic resin. As an additive mixed in order to regulate the electrical resistance value, the conductive filler is preferred, and an incompatible antistatic resin is more preferred. Where the conductive filler is used, the beltlike substrate may locally have very high conductivity depending on the state of dispersion to damage its breakdown strength. There, however, is no problem as long as the state of dispersion can uniformly be controlled. Also, in the case of the incompatible antistatic resin, it is of the same organic type as the binder resin thermoplastic resin. Hence, the former can readily uniformly be dispersed in the latter in streaks in a phase-separated state, and such streaks align in the direction of extrusion at the time of the blown-film extrusion. Thus, streak domains can be maintained at the surface layer of the belt, and hence appropriate leak sites can be kept with ease.

As a method preferable for controlling the state of dispersion, a method is available in which a pellet-like antistatic resin and a pulverized, powdery antistatic resin are used in combination in the stage of premixing. This aims at making dispersion uniform by virtue of such a particle-form antistatic resin to control electric-current non-uniformity, and also at maintaining appropriate leak sites to keep image characteristics favorable.

Besides, in order to improve uniformity, conditions of a premixing apparatus may be set by adjusting the shape of upper and lower blades of a stirring blade and making larger the number of revolutions for treatment, whereby the state of uniform dispersion of the antistatic resin can be achieved.

A method is also available in which the uniform dispersion is achieved by two-stage introduction, i.e., when materials are introduced into a premixing apparatus, the binder resin thermoplastic resin is previously introduced and other additives are introduced little by little with stirring.

Besides, a method is also available in which the particulate material and the pellet-like material are separately premixed, and these two are simultaneously introduced when introduced into a feeder at the time of kneading to knead them so that any classification due to a difference in specific gravity of the materials in the feeder can be prevented to achieve a state of more uniform dispersion.

Next, as conditions for the kneading, the preset temperature of each cylinder is controlled within the range of from 180° C. to 210° C. and in addition any error of pressure applied to the resin is kept within ±1 Pa so that more stable kneading can be carried out. Further, the number of revolutions of a screw is kept at 210 rpm or more so that a greater shear force may be applied to the materials. Under such kneading conditions, the state of uniform dispersion can be achieved. As a kneading apparatus, it is preferable to use an extruder of various types such as a twin-screw extruder or a single-screw extruder, mixers of various types such as a kneader or a Banbury mixer, or roll mills of various types such as a two-roll mill or a three-roll mill. In particular, in order to control dispersion, a twin-screw extruder is preferred. This is because the twin-screw extruder can afford to change screw construction with ease and conditions for the state of proper dispersion can be found by changing the screw construction, and also because the throughput and the number of revolutions can individually be controlled and hence the residence time of the resin can be changed, the state of dispersion can be changed in the state the screw is not changed, and optimum conditions for dispersion can be found with ease.

A kneading apparatus having a side feed in the middle of extrusion may further be used so that only the antistatic resin is introduced therefrom and the shear force applied to the antistatic resin can be controlled to be a little weak. This can maintain the streaky domains.

In the subsequent extrusion of the electrophotographic endless belt, it is preferable to employ the blown-film extrusion described above, also in a sense that the 25 μm×25 μm surface total current value of the beltlike substrate is regulated within the range of from 300 nA to 2,000 nA at the time of application of 100 V as measured by SPM. The blown-film extrusion may be carried out setting its temperature and throughput a little higher and setting its cooling rate and draw-off rate higher, so that the streak domains of the antistatic resin can be maintained when the molten resin comes out of the circular die. Also, a method is available in which a binder resin (thermoplastic resin) having a little lower MFR (melt flow rate) value is used in the additives mixed in order to control the electrical resistance value of the antistatic-resin and so forth, maintaining the structure in which an antistatic-resin is dispersed in a streak state (the streak domains).

Thus, by controlling the premixing conditions, the kneading conditions, the blown-film extrusion conditions and materials within the specific ranges, the additives mixed for controlling the electrical resistance value of the antistatic resin and so forth can be uniformly dispersed to maintain the streak domains. This makes it possible to regulate the 25 μm×25 μm surface total current value of the beltlike substrate within the range of from 300 nA to 2,000 nA at the time of application of 100 V as measured by SPM, and to achieve good image characteristics even in the high-temperature and high-humidity environment.

The meandering-preventive member of the electrophotographic endless belt according to the present invention may preferably have a thickness of from 0.3 mm to 6 mm. If it has a thickness of less than 0.3 mm, any sufficient meandering-preventive effect may not be obtained and, in some cases, the meandering-preventive member may even run on the roller. If, on the other hand, it has a thickness of more than 6 mm, the difference between the inner peripheral length of the beltlike substrate of the electrophotographic endless belt and the inner peripheral length of the meandering-preventive member may be so large that, in the actual use of the electrophotographic endless belt, the meandering-preventive member may greatly rise without following the bend of the electrophotographic endless belt when the electrophotographic endless belt is traveling on the roller over which it is put.

To attach the meandering-preventive member to the beltlike substrate, the former may preferably be attached to the latter with a pressure-sensitive adhesive double-coated tape as being inexpensive, enabling attachment with good precision and being capable of maintaining adherence over a long period of time. The pressure-sensitive adhesive double-coated tape may more preferably be one having a reinforcing base material (support) for its adhesive, in view of working precision, attachment precision, adherence, durability and so forth.

As to materials and characteristics of the reinforcing base material, there are no particular limitations as long as it can maintain the attachment precision. It may include, e.g., sheets of paper such as kraft paper, Japanese paper and crepe paper; single or mixed woven fabrics of rayon (staple fiber), cotton, acetate, glass, polyester, Vinylon and the like; fabrics of polyethylene, polypropylene and the like; nonwoven fabrics of rayon, polypropylene, aromatic polyamide, polyester, glass and the like; cellophane; films of acetate, polyvinyl chloride, polyethylene, polypropylene and the like; single or mixed rubber sheets of polyurethane rubber, natural rubber, styrene-butadiene rubber, polychloroprene rubber and the like; and foams of polyurethane, polyethylene, butyl rubber, polychloroprene rubber, acrylic rubber and the like.

Of these, Inaterials which may particularly preferably be used include nonwoven fabrics of rayon, polypropylene, aromatic polyamide, polyester, glass and the like. These have good workability, promise superior working precision and attachment precision, are available at a low price and have the effect of improving adhesive (pressure sensitive) strength greatly. The reinforcing base material of the pressure-sensitive adhesive double-coated tape may preferably have a thickness of from 25 μm to 500 μm.

As a pressure-sensitive adhesive (bonding material) of the pressure-sensitive adhesive double-coated tape, it may include rubber types such as urethane rubber, natural rubbers, styrene-butadiene rubbers, isobutylene rubbers, isoprene rubbers, a styrene-isoprene block copolymer and a styrene-butadiene block copolymer; acrylic types; and silicone types. Also, any of these materials, or any of these and other material, may be used in a combination of two or more. Of these, a pressure-sensitive adhesive double-coated tape making use of an acrylic pressure-sensitive adhesive is preferred as having superior adhesive strength.

As a material of the meandering-preventive member, any material may be used as long as they have a strength high enough to prevent the electrophotographic endless belt from meandering. For example, it may include solids or foams of isoprene rubber, styrene-buadiene rubber, butadiene rubber, ethylene-propylene rubber, chloroprene rubber, nitrile rubber, polyurethane rubber, epichlorohydrin rubber, silicone rubber, fluorine rubber and the like. In particular, polyurethane rubber and silicone rubber are preferred as having a compression set superior to that of other materials. Foams of these materials are also preferred as having superior flexibility, having less influence on the flexing properties of the electrophotographic endless belt and achieving stable belt-travel performance.

As the position detection member in the present invention, it may include members in the form of a seal (sticker) and those provided by coating. Taking account of coating precision or squeeze-out of coating materials, those in the form of a seal (position detection seal) are preferred as being attachable with a good precision, suitable for automation and able to achieve both high precision and low cost.

There are no particular limitations on the materials for a base material (support) of the position detection seal, and conventionally known materials may be used. For example, it may include sheets of paper such as kraft paper, Japanese paper and crepe paper; single or mixed woven fabrics of rayon (staple fiber), cotton, acetate, glass, polyester, Vinylon and the like; waste fabrics of polyethylene, polypropylene and the like; nonwoven fabrics of rayon, polypropylene, aromatic polyamide, polyester, glass and the like; cellophane; films of acetate, polyvinyl chloride, polyethylene, polypropylene, polyester and the like.

As a pressure-sensitive adhesive (bonding material) of the position detection seal, it may include rubber types such as urethane rubber, natural rubbers, styrene-butadiene rubbers, isobutylene rubbers, isoprene rubbers, a styrene-isoprene block copolymer and a styrene-butadiene block copolymer; acrylic types; and silicone types. Also, any of these materials, or any of these and other materials, may be used in a combination of two or more. Of these, a position detection seal making use of an acrylic pressure-sensitive adhesive is preferred as having superior adhesive strength.

As the construction of the position detection seal, it may be formed of a simplest combination of a single-layer base material and a single-layer pressure-sensitive adhesive, and also may be constituted of a plurality of base material layers and a plurality of pressure-sensitive adhesive layers as needed, or may be formed in multiple layers by coating or vacuum deposition.

As methods of preparing the position,detection seal, conventionally known methods may be employed. A method of preparing it by punching, making use of a punching cutter is preferable as promising manufacture with excellent precision, with good productivity and at low cost.

The electrophotographic endless belt of the present invention is also very preferably usable as an intermediate transfer belt for a process cartridge that integrally supports an intermediate transfer belt and an electrophotographic photosensitive member and is detachably mountable on the main body of an electrophotographic apparatus (an intermediate transfer belt/electrophotographic photosensitive member integral process cartridge).

Even where the intermediate transfer belt/electrophotographic photosensitive member integral process cartridge is placed in a severe environment of high-temperature and high-humidity during distribution in the market in the state in which it is over the rollers and maintained over the rollers for a long term and, by any chance, the meandering-preventive member has caused permanent deformation to have the habit of bending, the process cartridge is by no means influenced by such deformation as long as the intermediate transfer belt, which is the electrophotographic endless belt of the present invention, is used, because the position detection member is present at the place kept apart at the specific distance from the meandering-preventive member.

Meanwhile, when used as the intermediate transfer belt/electrophotographic photosensitive member integral process cartridge, the process cartridge is handled as an article for consumption. Hence, it is essential that the process cartridge be more inexpensively manufactured. Accordingly, the component parts included in it are also desired to be inexpensive. As in the present invention, the pressure-sensitive adhesive double-coated tape commercially available at a low price may be used to attach the meandering-preventive member to the electrophotographic endless belt (intermediate transfer belt). This is preferable because of the low cost involved. The position detection member may also only be stuck, and this is also preferable because of the low cost.

For the purpose of making the process cartridge compact and achieving a cost reduction, it is also preferable to use as a cleaning system of the intermediate transfer belt a cleaning-at-primary transfer method in which secondary-transfer residual toner is charged to a polarity reverse to that at the time of primary transfer and returned from the surface of the intermediate transfer belt to the latent-image-bearing member simultaneously with the primary transfer.

Stated specifically, it is a system in which electric charges with a polarity reverse to that at the time of primary transfer are imparted to the secondary-transfer residual toner by applying a voltage to a charge-providing means (e.g., a charge providing roller) disposed separably on the intermediate transfer belt, and are returned to the electrophotographic photosensitive member with the aid of a primary-transfer electric field at the subsequent primary-transfer zone. Of course, as the charge-providing means, a corona charging assembly or blade or the like may be used besides the roller. Any means having any shape may be used as long as the electric charges can be imparted to the secondary-transfer residual toner remaining on the intermediate transfer belt.

The toner returned from the surface of the intermediate transfer belt to the electrophotographic photosensitive member is removed by a cleaning means for the electrophotographic photosensitive member, such as a cleaning blade. This system is greatly effective to make the cartridge compact and low cost.

The intermediate transfer belt may also preferably be of a system in which it is put over two rollers, in view of such an advantage that a drive mechanism is simple, the number of component parts can be made small, and the cartridge can be made compact.

Of the rollers over which the intermediate transfer belt is put, a tension roller which applies a tension to the intermediate transfer belt may preferably be slidable by at least 1 mm with respect to the direction in which the intermediate transfer belt elongates. Also, in order for the intermediate transfer belt to be surely driven without slipping, the intermediate transfer belt may preferably be put over the rollers at a force of 5 N or more.

An electrophotographic apparatus is specifically described below which has an intermediate transfer belt/electrophotographic photosensitive member integral process cartridge making use of the electrophotographic endless belt as the intermediate transfer belt.

Figure 1:
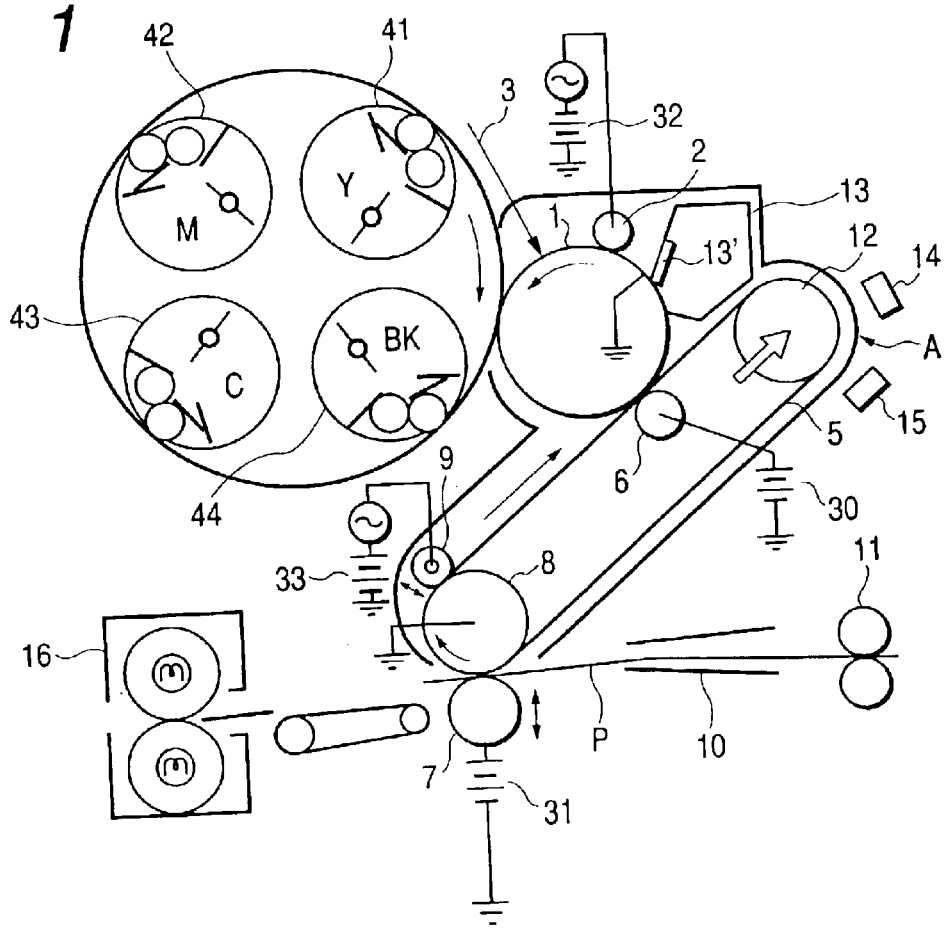
FIG. 1 is a schematic view showing an example of the construction of an electrophotographic apparatus having a process cartridge of the present invention in which an intermediate transfer belt and an electrophotographic photosensitive member are integrally held together.

FIG. 1 is a schematic view showing an example of the construction of an electrophotographic apparatus having an intermediate transfer belt/electrophotographic photosensitive member integral process cartridge (FIG. 2 as referred to later) of the present invention.

In the apparatus shown in FIG. 1, a drum-shaped electrophotographic photosensitive member (photosensitive drum) 1 is rotatably driven at a prescribed peripheral speed (process speed) in the direction of an arrow.

The electrophotographic photosensitive member 1 is, in the course of its rotation, uniformly charged to a prescribed polarity and potential by means of a roller shaped (primary-) charging means (charging roller) 2. Reference numeral 32 denotes a power source for the charging means. A bias formed by superimposing an alternating current on a direct-current may be applied, or only a direct current voltage may be applied.

Subsequently, the electrophotographic photosensitive member is subjected to exposure light 3 by an exposure means (not shown; e.g., a color original image color-separating/image-forming optical system, or a scanning exposure system comprising a laser scanner that outputs laser beams modulated in accordance with time-sequential electrical digital pixel signals of image information). Thus, an electrostatic latent image is formed that corresponds to a first color component image (e.g., a yellow color component image) of the intended full-color image.

Next, the electrostatic latent image is developed with a first-color yellow toner Y by means of a first developing means (yellow color developing means 41) to form a yellow toner image. At this stage, second to fourth developing means (magenta color developing means 42, cyan color developing means 43 and black color developing means 44) each stand unoperated and do not act on the electrophotographic photosensitive member 1, and hence the first-color yellow toner image is not affected by the second to fourth developing means.

An intermediate transfer belt S is rotatably driven in the direction of an arrow at the same peripheral speed as the electrophotographic photosensitive member 1. The first-color yellow toner image formed and held on the electrophotographic photosensitive member 1 passes through a contact zone between the electrophotographic photosensitive member 1 and the intermediate transfer belt 5, in the course of which it is successively primarily transferred to the outer periphery of the intermediate transfer belt 5 by the aid of an electric field formed by a primary-transfer bias applied from a roller-shaped primary-transfer means (primary-transfer-roller) 6 to the intermediate transfer belt.

The surface of the electrophotographic photosensitive member 1 from which the corresponding first-color yellow toner image has been transferred to the intermediate transfer belt 5 is cleaned by an electrophotographic photosensitive member cleaning means 13 having a cleaning blade 13'.

Then, the second-color magenta toner image, the third-color magenta toner image and the fourth-color black toner image are sequentially likewise transferred and superimposed onto the intermediate transfer belt 5. Thus, a synthesized full-color toner image corresponding to the intended full-color image is formed on the intermediate transfer belt 5.

Here, the position of the intermediate transfer belt is detected by a position detection sensor 15. A density detection sensor 14 is also provided in order to detect a patch for controlling density.

A roller-shaped secondary-transfer means (secondary-transfer roller) 7 is provided in such a state that it is axially supported correspondingly, and in parallel, to a secondary-transfer opposing roller 8 and stands separable from the bottom surface of the intermediate transfer belt 5.

The primary transfer bias for sequentially superimposing and transferring the first- to fourth-color toner images from the electrophotographic photosensitive member 1 to the intermediate transfer belt 5 is applied from a bias power source 30 with a polarity (+) reverse to that of each toner. The voltage thus applied may preferably be in the range of from +100 V to +2 kV.

In the step of primarily transferring the first- to third-color toner images from the electrophotographic photosensitive member 1 to the intermediate transfer belt 5, the secondary-transfer roller 7 may also be made to stand separate from the intermediate transfer belt 5.

The synthesized full-color toner image having been transferred onto the intermediate transfer belt 5 is transferred to a second image-bearing member transfer material P in the following way: The secondary transfer roller 7 is brought into contact with the intermediate transfer belt 5 and simultaneously the transfer material P is fed at a prescribed timing from a roller-shaped paper feed means (paper feed roller) 1 through a transfer material guide 10 to the contact zone formed between the intermediate transfer belt 5 and the secondary-transfer roller 7, where a secondary-transfer bias is applied to the secondary-transfer roller 7 from a power source 31. Upon application of this secondary-transfer bias, the synthesized full-color toner image is secondarily transferred from the intermediate transfer belt 5 to the second image-bearing member transfer material P. The transfer material P to which the synthesized full-color toner image has been transferred are guided into a roller-shaped fixing means (fixing roller) 16 and are heat-fixed there.

After the synthesized full-color toner image has been transferred to the transfer material P, a roller-shaped charge-providing means (charge-providing roller) 9 disposed separably is brought into contact with the intermediate transfer belt 5, and a bias with a polarity reverse to that of the electrophotographic photosensitive member 1 is applied, whereupon electric charges with a polarity reverse to that at the time of primary transfer are imparted to secondary-transfer residual toners, not transferred to the transfer material P and remaining on the intermediate transfer belt S. Reference numeral 33 denotes a bias power source. Here, a bias formed by superimposing an alternating current on a direct current is applied.

The secondary-transfer residual toners charged to the polarity reverse to that at the time of primary transfer are electrostatically transferred to the electrophotographic photosensitive member 1 at the contact zone formed between the intermediate transfer belt 5 and the electrophotographic photosensitive member 1 and the vicinity thereof, thus cleaning the intermediate transfer belt 5. This step can be carried out simultaneously with the primary transfer, and hence the throughput does not decrease.

The intermediate transfer belt/electrophotographic photosensitive member integral process cartridge of the present invention which is mounted on the electrophotographic apparatus shown in FIG. 1, is described below in greater detail.

Figure 2:
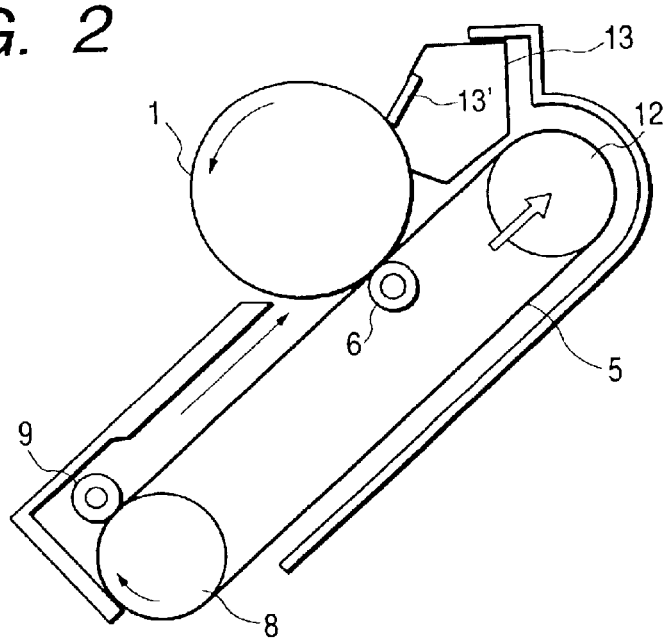
FIG. 2 is a schematic view showing an example of the construction of a process cartridge of the present invention in which an intermediate transfer belt and an electrophotographic photosensitive member are integrally held together.

FIG. 2 is a schematic view showing an example of the construction of the process cartridge of the present invention.

In the process cartridge shown in FIG. 2, at least an intermediate transfer belt 5, an electrophotographic photosensitive member 1, an electrophotographic photosensitive member cleaning means 13 having a cleaning blade 13' and a charge-providing means (charge-providing roller) 9 integrally constitute one unit so that it is detachably mountable on the main body of the electrophotographic apparatus.

The cleaning of the intermediate transfer belt 5 employs a system in which the secondary-transfer residual toners are charged to a polarity reverse to that at the time of primary transfer, as described previously, and thereby returned from the intermediate transfer belt to the electrophotographic photosensitive member at the contact zone between the intermediate transfer belt and the electrophotographic photosensitive member. In the process cartridge shown in FIG. 2, a roller-shaped charge-providing means (charge-providing roller) 9 comprised of a medium-resistance elastic body is provided. Then, the cleaning of the electrophotographic photosensitive member is blade cleaning performed by the cleaning blade 13'. A waste-toner container (not shown) is also integrally provided so that the transfer residual toners on both the intermediate transfer belt and the electrophotographic photosensitive member can simultaneously be discarded when the process cartridge is replaced. Thus, it contributes to an improvement in maintenance performance.

The intermediate transfer belt 5 is also put over two rollers, a secondary-transfer opposing roller 8 and a tension roller 12 so that the number of component parts can be made small and the cartridge can be made compact.

Here, the secondary-transfer opposing roller 8 is a drive roller for driving the intermediate transfer belt and at the same time an opposing roller of the charge-providing roller 9. The tension roller 12, which rotates following the intermediate transfer belt, has a sliding mechanism, and is brought into pressure contact with the inside of the belt in the direction of an arrow by the action of a compression spring to impart a tension to the intermediate transfer belt. It may preferably be slidable over a slide width of from 1 to 5 mm, and the spring may preferably apply a pressure of from 5 to 70 N in total. Also, the electrophotographic photosensitive member 1 and the secondary-transfer opposing roller 8 (serving also as a drive roller) have a coupling (not shown) between them so that the rotational driving force is transmitted from the main body.

In those shown in FIGS. 1 and 2, the secondary-transfer opposing roller 8 (serving also as a drive roller) is also a roller provided on one end in the axial direction thereof with a terraced portion in which the meandering-preventive member of the intermediate transfer belt fits. The tension roller 12 is also a roller provided over the whole outer periphery thereof with a groove that may fit in the cross-sectional shape of the meandering-preventive member of the intermediate transfer belt.

The intermediate transfer belt/electrophotographic photosensitive member integral process cartridge shown in FIG. 2 may be integral at least at the time it is used by users. Taking account of the handling in the course of its manufacture and the readiness to disassemble them after recovery, it is preferably designed so that it can be divided into some units, e.g., an intermediate transfer belt unit having the intermediate transfer belt and an electrophotographic photosensitive member unit having the electrophotographic photosensitive member.

As a position detection means for detecting the position detection member provided on the electrophotographic endless belt, a conventionally known method may be used. In particular, in the present inventions, it is preferable to use, e.g., a photoelectric sensor (position detection sensor) making use of visible light rays, infrared rays or the like, and in particular, a reflection type position detection sensor. If a transmission type sensor is used as the position detection sensor of the electrophotographic endless belt, there are restrictions on the materials used for the intermediate transfer belt. Especially in the case of the intermediate transfer belt/electrophotographic photosensitive member integral process cartridge as in the present invention, the light-projection part and light-receiving part of the position detection sensor must be put separately on the electrophotographic apparatus main body side and on the process cartridge side. This not only may lower detection precision, but also may cause a rise in costs of the process cartridge.

In the foregoing, the present invention has been described mainly in the case in which the electrophotographic endless belt is used as the intermediate transfer belt. Besides the intermediate transfer belt, the electrophotographic endless belt of the present invention is also applicable to a belt at large for which the prevention of meandering and the detection of position are required, such as photosensitive belts, transfer belts, transport belts and fixing belts.

The characteristics in the present invention are all measured in the following manner.

Measurement of layer thickness:

The layer thickness of the beltlike substrate of the electrophotographic endless belt (intermediate transfer belt) is found, in the case of a single layer, by measuring with a dial gauge the cross sections of samples cut at eight spots at equal intervals over the whole periphery of the middle of the belt and averaging the measurements, and in the case of multiple layers, by observing and measuring such cross sections with an optical microscope and averaging the measurements.

Measurement of surface total current value:

As a measuring instrument, SPM: scanning-probe microscope (manufactured by Seiko Instruments Co.) is used, and SPA400-AMF (atomic-force microscope; electric-current simultaneous measurement) is connected thereto to make a measurement.

Scanning area: 24,794 nm square.

Applied voltage: 100 V.

Sample: The belt is cut in a 5 mm square.

With respect to the 25 $\mu$m×25 $\mu$m surface, electric current is measured at 256×256 spots in one-time measurement, and the total of measurements is regarded as the total current value. Then, this measurement is made ten times in total per one beltlike substrate, shifting measurement position. The average value of the total current values obtained is regarded as the 25 $\mu$m×25 $\mu$m surface total current value of the belt.

The present invention is described below in greater detail by giving specific working examples. In the following Examples, "part(s)" means part(s) by weight.

EXAMPLE 1

| | |
|---|---|
| Polyvinylidene fluoride resin (KEINER 720, trade name; available from Elfatochem Co.) | 72.7 parts |
| Polyether ester amide pelletlike; PELESTAT NC6321, trade name; available from Sanyo Kasei Kogyo K.K.) | 7 parts |
| Potassium perfluorobutane sulfonate | 0.3 part |
| Zinc oxide particles (volume-average particle diameter: 0.5 $\mu$m) | 20 parts |

In the above formulation, a portion of 3 parts in 7 parts of the polyether ester amide was used after being made into powder by means of a grinding mill, and the remaining 4 parts of the polyether ester amide was used in the form of pellets. Also, the polyether ester amide were used, having a little higher MFR value than the polyvinylidene fluoride resin.

Next, the powdery polyether ester amide, potassium perfluorobutane sulfonate and zinc oxide particles and the pellet-like polyvinylidene fluoride resin and polyether ester amide were separately premixed. As conditions of a premixing apparatus, the upper blade/lower blade of its stirring blade was set in the type of S/BL, and the number of revolutions for treatment was set at 30 Hz.

Next, the powdery materials and the pellet-like materials both having been thus premixed were kneaded, introducing them little by little into a feeder of a kneading apparatus. Here, the kneading was carried out under conditions of an extrusion temperature of 210° C. and a number of screw revolutions of 450 rpm. The kneading was also carried out controlling the kneading resin pressure at a deflection of ±1 Pa.

As the kneading apparatus, a twin-screw extruder 30 mm in diameter of a same-direction rotation-engagement type was used, which was further provided with a side feeder in the middle of extrusion. Then, when the materials were kneaded, a portion of 2 parts of 4 parts of the pellet-like polyether ester amide resin was introduced from the side feeder provided in the middle of extrusion. Then, the additives such as the polyether ester amide resin were sufficiently uniformly dispersed in the binder so that the desired streak domains and the micro-ranged electrical resistance were achieved. Through this kneading, an extrusion material made into pellets of 2 mm diameter was obtained.

Next, in the extrusion apparatus shown in FIG. 3, the extruder die 103 was set as a single-layer circular die, where a die slit outer diameter was 100 mm. The die slit was 0.8 mm in width.

Then, the above extrusion material, having been well dried by heating, was put into the hopper 102 of this extrusion apparatus, and heated and melted. The molten product obtained was extruded at 210° C. from the circular die. The outside-cooling ring 105 was provided around the circular die 103, and air was blown from the circumference to the film extruded in tubular form to effect cooling.

Next, air was blown to the interior of the extruded tubular film through the gas inlet passage 104 to cause the film to inflate while scaling up until it came to have a diameter of 220 mm. Thereafter, the film was continuously drawn off at a constant speed by means of the draw-off unit. The proportion of the diameter of the circular die 103 to the diameter of the tubular film extruded came to 220%. Here, the air was stopped being fed at the time the diameter came to the desired value.

Then, subsequent to the draw-off through the pinch rollers, the tubular film was cut with the cutter 108.

After its thickness became uniform, the film was cut to a length of 370 mm to form a tubular film.

On this tubular film, its size and surface smoothness were regulated and folds were removed, using a pair of cylindrical forms made of metals having different coefficient of thermal expansion. The tubular film was placed over the cylindrical form (inner form) having a higher coefficient of thermal expansion, and this inner form with film was inserted into the cylindrical form (outer form) having been worked to have a smooth inner surface, followed by heating at 170° C. for 20 minutes. After cooling to room temperature, the tubular film was removed from the inner and outer forms, thus obtaining a surface worked tubular film. Since the metal oxide particles used were white, the surface-worked tubular film was white.

Both ends of the surface-worked tubular film were precisely cut away to obtain a beltlike substrate of 290 mm in width. This beltlike substrate was 85 $\mu$m in thickness, and its resistivity was measured to find that it had a volume resistivity of $3.3\times10^{10}\Omega\cdot$cm and a surface resistivity of $2.6\times10^{11}\Omega\cdot\square$.

The 25 $\mu$m×25 $\mu$m surface total current value of the beltlike substrate at the time of application of 100 V as measured by SPM was 760 nA.

A pressure-sensitive adhesive double-coated tape comprised of a nonwoven fabric base material of 50 $\mu$m in thickness on one side and the other side of which an acrylic pressure-sensitive adhesive was provided respectively at a thickness of 55 $\mu$m and 155 $\mu$m was stuck to a polyurethane foam of 1.5 mm in thickness in such a way that the 155 $\mu$m thick adhesive side was on the polyurethane foam side, and these were cut in a width of 5 mm and a length of 688 mm to make a meandering-preventive member.

Then, a polyethylene terephthalate (PET) film of 50 $\mu$m in thickness, on one side of which a black coating was provided and on the other side of which an acrylic pressure-sensitive adhesive (20 $\mu$m thick) was provided, was punched out in a 10 mm length×10 mm width to make a position detection seal. While the beltlike substrate was white, the position detection seal was black, and has a different reflectance.

The above meandering-preventive member was attached to one end portion of the beltlike substrate obtained by extrusion as described above, and in the peripheral direction of the inner periphery of the beltlike substrate at a position 3 mm shifted to the middle from the end.

On the outer periphery of the beltlike substrate at its end portion opposite to the end portion to which the meandering-preventive member was attached, the above position detection seal was further stuck along the former's end, at four spots at equal intervals in the peripheral direction of the beltlike substrate, thus obtaining an intermediate transfer belt. The distance between the meandering-preventive member and the position detection seal (position detection member) in the width direction was 235 mm. The meandering-preventive member and the position detection member were both attached at the non-image formation region.

Image evaluation:

The intermediate transfer belt thus obtained was set in the electrophotographic apparatus constructed as shown in FIG. 1, and full-color images were reproduced on paper of 80 g/m$^2$ (basis weight) to conduct a print test. An exposure unit used here was of a 600 dpi digital laser system. Here, test was conducted in two environments of a normal-temperature and normal-humidity environment (23° C., 60% RH) and a high-temperature and high-humidity environment (40° C., 90% RH). With respect to the test in the high-temperature and high-humidity environment, it was conducted after the electrophotographic apparatus was left standing for a week in that environment, and faulty images were checked in addition to color misregistration. Images obtained in each environment were visually evaluated.

Subsequently, a running (extensive operation) test was conducted by continuous printing on 8,000 sheets at a process speed of 4 sheets per minute to make image evaluation similarly.

In the test in the high-temperature and high-humidity environment, stripelike image defects were also examined to make evaluation in the following way.

The intermediate transfer belt was left standing in that environment (40° C., 90% RH) for a week, and thereafter set in the (full-color) electrophotographic apparatus constructed as shown in FIG. 1. In that environment, black, magenta and cyan halftone images and solid images were printed on paper of 80 g/m$^2$. Then, printed images were visually evaluated according to ranks defined as follows:

A: Any stripelike image defects do not appear on images at all.

B: Stripelike image defects appear in a width region of less than ½ of the width of image formation region.

C: Stripelike image defects appear in a width region of ½ or more of the width of image formation region.

The results of evaluation are shown in Table 1.

EXAMPLE 2

| | |
|---|---|
| Polyvinylidene fluoride resin (KEINER 720) | 60 parts |
| Conductive carbon black | 20 parts |
| Zinc oxide particles (volume-average particle diameter: 0.5 $\mu$m) | 20 parts |

A beltlike substrate was obtained in the same manner as in Example 1 except that the formulation of materials was changed as shown above and the beltlike substrate was made to have a diameter of 140 mm and a width of 250 mm.

The same meandering-preventive member as that in Example 1 was attached to one end portion of the beltlike substrate obtained by extrusion as described above, and in the peripheral direction of the inner periphery of the beltlike substrate at a position 3 mm shifted to the middle from the end.

On the outer periphery of the beltlike substrate at its end portion opposite to the end portion to which the meandering-preventive member was attached, the same position detection seal as that in Example 1 was further stuck along the former's end, at four spots at equal intervals in the peripheral direction of the beltlike substrate, thus obtaining an intermediate transfer belt. The distance between the meandering-preventive member and the position detection member in the width direction was 220 mm. The meandering-preventive member and the position detection member were both attached at the non-image formation region.

The 25 μm×25 μm surface total current value of the beltlike substrate at the time of application of 100 V as measured by SPM was 1,500 nA.

The intermediate transfer belt thus obtained was set in the electrophotographic apparatus constructed as shown in FIG. 1, and full-color images were reproduced to conduct a print test and make evaluation in the same manner as in Example 1. The results of evaluation are shown in Table 1.

EXAMPLE 3

| | |
|---|---|
| Polyvinylidene fluoride resin (KEINER 720) | 65 parts |
| Polyether ester amide (PELESTAT NC6321) | 15 parts |
| Zinc oxide particles (volume-average particle diameter: 0.5 μm) | 20 parts |

A beltlike substrate was obtained in the same manner as in Example 1 except that the formulation of materials was changed as shown above and the beltlike substrate was made to have a diameter of 142 mm and a width of 255 mm.

The same meandering-preventive member as that in Example 1 was attached to one end portion of the beltlike substrate obtained by extrusion as described above, and in the peripheral direction of the inner periphery of the beltlike substrate at a position 3 mm shifted to the middle from the end.

On the outer periphery of the beltlike substrate at its end portion opposite to the end portion to which the meandering-preventive member was attached, the same position detection seal as that in Example 1 was further stuck along the former's end, at four spots at equal intervals in the peripheral direction of the beltlike substrate, thus obtaining an intermediate transfer belt. The distance between the meandering-preventive member and the position detection member in the width direction was 225 mm. The meandering-preventive member and the position detection member were both attached at the non-image formation region.

The 25 μm×25 μm surface total current value of the beltlike substrate at the time of application of 100 V as measured by SPM was 560 nA.

The intermediate transfer belt thus obtained was set in the electrophotographic apparatus constructed as shown in FIG. 1, and full-color images were reproduced to conduct a print test and make evaluation in the same manner as in Example 1. The results of evaluation are shown in Table 1.

Comparative Example 1

| | |
|---|---|
| Polyvinylidene fluoride resin (KEINER 720) | 78 parts |
| Potassium perfluorobutane sulfonate | 2 part |
| Zinc oxide particles (volume-average particle diameter: 0.5 μm) | 20 parts |

The materials formulated as described above were premixed at a time. Thereafter, the mixture obtained was kneaded by means of a kneading apparatus making use of a single-screw extruder. Through this kneading, an extrusion material made into pellets of 2 mm diameter was obtained. The subsequent extrusion process of Example 1 was repeated to obtain a beltlike substrate.

The same meandering-preventive member as that in Example 1 was attached to one end portion of the beltlike substrate obtained by extrusion as described above, and in the peripheral direction of the inner periphery of the beltlike substrate at a position 3 mm shifted to the middle from the end.

On the outer periphery of the beltlike substrate at its end portion to which the meandering-preventive member was attached, the same position detection seal as that in Example 1 was further stuck along the former's end, at four spots at equal intervals in the peripheral direction of the beltlike substrate, thus obtaining an intermediate transfer belt. Here, the meandering-preventive member and the position detection member were both attached at the non-image formation region.

The 25 μm×25 μm surface total current value of the beltlike substrate at the time of application of 100 V as measured by SPM was 230 nA.

The intermediate transfer belt thus obtained was set in the electrophotographic apparatus constructed as shown in FIG. 1, and full-color images were reproduced to conduct a print test and make evaluation in the same manner as in Example 1. The results of evaluation are shown in Table 1.

Comparative Example 2

| | |
|---|---|
| Low density polyethylene (920 g/m$^2$) | 94 parts |
| Acryl rubber particles | 6 parts |

An intermediate transfer belt was obtained in the same manner as in Comparative Example 1 except that the formulation of extrusion materials for the beltlike substrate was changed as shown above.

The 25 μm×25 μm surface total current value of the beltlike substrate at the time of application of 100 V as measured by SPM was 110 nA.

The intermediate transfer belt thus obtained was set in the electrophotographic apparatus constructed as shown in FIG. 1, and full-color images were reproduced to conduct a print test and make evaluation in the same manner as in Example 1. The results of evaluation are shown in Table 1.

Comparative Example 3

| | |
|---|---|
| Ethylene-tetrafluoroethylene copolymer | 70 parts |
| Conductive carbon | 30 parts |

An intermediate transfer belt was obtained in the same manner as in Comparative Example 1 except that the formulation of extrusion materials for the beltlike substrate was changed as shown above.

The intermediate transfer belt thus obtained was set in the electrophotographic apparatus constructed as shown in FIG. 1, and full-color images were reproduced to conduct a print test and make evaluation in the same manner as in Example 1. The results of evaluation are shown in Table 1.

Reference Example 1

| | |
|---|---|
| Polyvinylidene fluoride resin (KEINER 720) | 71.0 parts |
| Polyether ester amide (PELESTAT NC6321) | 9 parts |
| Zinc oxide particles (volume-average particle diameter: 0.5 μm) | 20 parts |

The materials formulated as described above were premixed at a time. Thereafter, the mixture obtained was kneaded by means of a kneading apparatus making use of a single-screw extruder. Through this kneading, an extrusion material made into pellets of 2 mm diameter was obtained.

The subsequent extrusion process of Example 1 was repeated to obtain a beltlike substrate, and the same meandering-preventive member and position detection member as those in Example 1 were attached in the same manner as in Example 1 to obtain an intermediate transfer belt.

The 25 μm×25 μm surface total current value of the beltlike substrate at the time of application of 100 V as measured by SPM was 200 nA.

The intermediate transfer belt thus obtained was set in the electrophotographic apparatus constructed as shown in FIG. 1, and full-color images were reproduced to conduct a print test and make evaluation in the same manner as in Example 1. The results of evaluation are shown in Table 1.

Reference Example 2

| | |
|---|---|
| Polyvinylidene fluoride resin (KEINER 720) | 58 parts |
| Conductive carbon black | 22 parts |
| Zinc oxide particles (volume-average particle diameter: 0.5 μm) | 20 parts |

A beltlike substrate was obtained in the same manner as in Reference Example 1 except that the formulation of materials was changed as shown above. The same meandering-preventive member and position detection member as those in Example 1 were attached in the same manner as in Example 1 to obtain an intermediate transfer belt.

The 25 μm×25 μm surface total current value of the beltlike substrate at the time of application of 100 V as measured by SPM was 2,800 nA.

The intermediate transfer belt thus obtained was set in the electrophotographic apparatus constructed as shown in FIG. 1, and full-color images were reproduced to conduct a print test and make evaluation in the same manner as in Example 1. The results of evaluation are shown in Table 1.

TABLE 1

| | Distance between meandering preventive member and position detection member (mm) | 25 μm × 25 μm surface total current value (nA) | Volume resistivity ($\times 10^{10}$ Ω · cm) | Surface resistivity ($\times 10^{10}$ Ω/sq.) | N/N Image or color misreg.* Initial stage | N/N After running | H/H Initial stage | H/H After running | Stripe-like image defects |
|---|---|---|---|---|---|---|---|---|---|
| Example: | | | | | | | | | |
| 1 | 235 | 760 | 3.3 | 26 | Good. | Good. | Good. | Good. | A |
| 2 | 220 | 2,000 | 2.5 | 13 | Good. | Good. | Good. | Good. | A |
| 3 | 225 | 310 | 6.3 | 140 | Good. | Good. | Good. | Good. | A |
| Comparative Example: | | | | | | | | | |
| 1 | End portion on the same side. | 230 | 6.6 | 13 | Occur. | Occur. | Occur. | Occur. | C |
| 2 | End portion on the same side. | 110 | 5.5 | 19 | Occur. | Occur. | Occur. | Occur. | C |
| 3 | End portion on the same side. | 5,500 | 1.3 | 9.4 | Occur. | Occur. | Occur. | Occur. | B |
| Reference Example: | | | | | | | | | |
| 1 | 235 | 200 | 5.3 | 42 | Good. | Good. | Good. | Good. | B |
| 2 | 235 | 2,800 | 1.2 | 8.9 | Good. | Good. | Good. | Good. | B |

N/N: Normal temperature and normal humidity environment
H/H: High-temperature and high-humidity environment
*misreg.: misregistration According to the present invention, an electrophotographic endless belt can be provided which can obtain high-quality images having less color misregistration or image misregistration because of good meandering prevention and accurate position detection and does not cause any stripelike image defects even in the high-temperature and high-humidity environment.

According to the present invention, an intermediate transfer belt comprised of the above electrophotographic endless belt, and a process cartridge and an electrophotographic apparatus which have the intermediate transfer belt, can also be provided.

What is claimed is:

1. An electrophotographic endless belt comprising:

a beltlike substrate;

a meandering-preventive member; and a position detection member, wherein said meandering-preventive member is disposed on the inner-periphery side of one end portion of said beltlike substrate, wherein said position detection member is disposed on the outer-periphery side of the other end portion of said beltlike substrate, wherein said meandering-preventive member and said position detection member are kept apart by a distance of from 200 mm to 250 mm in the width direction of said electrophotographic endless belt, wherein said beltlike substrate contains a thermoplastic resin as a binder resin, and wherein said beltlike substrate has a 25 $\mu$m×25 $\mu$m surface total current value of from 300 nA to 2,000 nA at the time of application of 100 V as measured by scanning probe microscopy.

2. The electrophotographic endless belt according to claim 1, wherein said meandering-preventive member and said position detection member are kept apart by a distance of from 220 mm to 250 mm in the width direction of said electrophotographic endless belt.

3. The electrophotographic endless belt according to claim 1, wherein said meandering-preventive member and said position detection member are each disposed in a non-image formation region of said beltlike substrate.

4. The electrophotographic endless belt according to claim 1, wherein said electrophotographic endless belt is an intermediate transfer belt.

5. A process cartridge detachably mountable on a main body of an electrophotograhic apparatus, said process cartridge comprising:

an intermediate transfer belt comprising:

a beltlike substrate;

a meandering-preventive member; and a position detection member, wherein said meandering-preventive member is disposed on the inner-periphery side of one end portion of said beltlike substrate, wherein said position detection member is disposed on the outer-periphery side of the other end portion of said beltlike substrate, wherein said meandering-preventive member and said position detection member are kept apart by a distance of from 200 mm to 250 mm in the width direction of said intermediate transfer belt, wherein said beltlike substrate contains a thermoplastic resin as a binder resin, and wherein said beltlike substrate has a 25 $\mu$m×25 $\mu$m surface total current value of from 300 nA to 2,000 nA at the time of application of 100 V as measured by scanning probe microscopy.

6. The process cartridge according to claim 5, wherein said intermediate transfer belt is integrally supported with at least an electrophotographic photosensitive member for holding a toner image thereon and said intermediate transfer belt forms a contact zone between itself and the electrophotographic photosensitive member.

7. The process cartridge according to claim 5, wherein said meandering-preventive member and said position detection member are kept apart by a distance of from 220 mm to 250 mm in the width direction of said intermediate transfer belt.

8. The process cartridge according to claim 5, wherein said meandering-preventive member and said position detection member are each disposed in a non-image formation region of said beltlike substrate.

9. The process cartridge according to claim 5, further comprising at least one of a light-projecting part of a position detection sensor and a light-receiving part of the position detection sensor.

10. The process cartridge according to claim 9, wherein the position detection sensor is a reflection type position detection sensor.

11. An electrophotographic apparatus comprising:

an electrophotographic photosensitive member configured to hold a toner image thereon;

charging means for charging said electrophotographic photosensitive member electrostatically;

exposure means for forming an electrostatic latent image on said electrophotographic photosensitive member having been charged by said charging means;

developing means for developing the electrostatic latent image formed on said electrophotographic photosensitive member by said exposure means, to form a toner image on said electrophotographic photosensitive member;

an intermediate transfer belt which forms a contact zone between itself and said electrophotographic photosensitive member so that said intermediate transfer belt receives the toner image from said electrophotographic photosensitive member in a primary transfer operation, said intermediate transfer belt being configured and positioned to secondarily transfer to a transfer material the toner image primarily transferred thereto from said electrophotographic photosensitive member; and primary transfer means for transferring the toner image primarily from said electrophotographic photosensitive member to said intermediate transfer belt at the contact zone therebetween in the primary transfer operation, said intermediate transfer belt comprising:

a beltlike substrate;

a meandering-preventive member; and a position detection member, wherein said meandering-preventive member is disposed on the inner-periphery side of one end portion of said beltlike substrate, wherein said position detection member is disposed on the outer-periphery side of the other end portion of said beltlike substrate, wherein said meandering-preventive member and said position detection member are kept apart by a distance of from 200 mm to 250 mm in the width direction of said intermediate transfer belt, wherein said beltlike substrate contains a thermoplastic resin as a binder resin, and wherein said beltlike substrate has a 25 $\mu$m×25 $\mu$m surface total current value of from 300 nA to 2,000 nA at the time of application of 100 V as measured by scanning probe microscopy.

12. The electrophotographic apparatus according to claim 11, further comprising a process cartridge in which at least said electrophotographic photosensitive member and said intermediate transfer belt are integrally supported and which is detachably mountable on the main body of said electrophbtographic apparatus.

13. The electrophotographic apparatus according to claim 11, wherein said meandering-preventive member and said position detection member are kept apart by a distance of from 220 mm to 250 mm in the width direction of said intermediate transfer belt.

14. The electrophotographic apparatus according to claim 11, wherein said meandering-preventive member and said position detection member are each disposed in a non-image formation region of said beltlike substrate.

15. The electrophotographic apparatus according to claim 11, further comprising a position detection sensor.

16. The electrophotographic apparatus according to claim 15, further comprising a process cartridge in which at least one of a light-projecting part of said poison detection sensor and a light-receiving part of said position detection sensor, said intermediate transfer belt, and said electrophotographic photosensitive member are integrally supported and which is detachably mountable to a main body of said electrophotographic apparatus.

17. The electrophotographic apparatus according to claim 15, wherein said position detection sensor is a reflection type position detection sensor.

* * * * *

UNITED STATES PATENT AND TRADEMARK OFFICE

CERTIFICATE OF CORRECTION

PATENT NO. : 6,853,824 B2
DATED : February 8, 2005
INVENTOR(S) : Ryota Kashiwabara et al.

It is certified that error appears in the above-identified patent and that said Letters Patent is hereby corrected as shown below:

Column 3,
Line 38, "can not" should read -- cannot --.

Column 6,
Line 12, "letter 1 L" should read -- letter L --.

Column 7,
Line 3, "Mpa The" should read -- Mpa.¶The --.

Column 8,
Line 41, close up right margin.
Line 42, close up left margin.

Column 12,
Line 12, "Inaterials" should read -- materials --.

Column 13,
Line 16, "position,detection" should read -- position detection --.

Column 15,
Line 7, "S" should read -- 5 --.

Column 16,
Line 13, "S" should read -- 5 --.

UNITED STATES PATENT AND TRADEMARK OFFICE

CERTIFICATE OF CORRECTION

PATENT NO. : 6,853,824 B2
DATED : February 8, 2005
INVENTOR(S) : Ryota Kashiwabara et al.

It is certified that error appears in the above-identified patent and that said Letters Patent is hereby corrected as shown below:

Column 28,
Line 5, "posion" should read -- position --.

Signed and Sealed this

Sixth Day of September, 2005

JON W. DUDAS
*Director of the United States Patent and Trademark Office*